US009061334B2

(12) United States Patent
Bender et al.

(10) Patent No.: US 9,061,334 B2
(45) Date of Patent: Jun. 23, 2015

(54) DEVICE FOR HANDLING AND/OR TRANSPORTING ROLLS OF A ROLL STAND

(75) Inventors: Hans-Jürgen Bender, Olpe (DE); Hans-Jürgen Hanke, Hilchenbach (DE)

(73) Assignee: SMS SIEMAG AKTIENGESELLSCHAFT, Düsseldorf (DE)

( * ) Notice: Subject to any disclaimer, the term of this patent is extended or adjusted under 35 U.S.C. 154(b) by 122 days.

(21) Appl. No.: 13/390,375

(22) PCT Filed: Aug. 11, 2010

(86) PCT No.: PCT/EP2010/004904

§ 371 (c)(1),
(2), (4) Date: Mar. 26, 2012

(87) PCT Pub. No.: WO2011/018215

PCT Pub. Date: Feb. 17, 2011

(65) Prior Publication Data

US 2012/0174817 A1 Jul. 12, 2012

(30) Foreign Application Priority Data

Aug. 14, 2009 (DE) ..... 10 2009 037 665

(51) Int. Cl.
*B21B 31/10* (2006.01)
*B61J 1/10* (2006.01)

(52) U.S. Cl.
CPC ..... *B21B 31/103* (2013.01); *B21B 31/10* (2013.01); *B21B 2203/32* (2013.01)

(58) Field of Classification Search
CPC B21B 31/103; B21B 31/10; B21B 2013/025; B21B 31/08; B21B 13/02; B21B 2203/32; B21B 31/00; B61B 5/00; B61B 5/02
USPC ..... 104/34, 48, 49, 50, 127, 128, 129; 72/238, 239; 105/26.05
See application file for complete search history.

(56) References Cited

U.S. PATENT DOCUMENTS

| | | | | |
|---|---|---|---|---|
| 3,438,996 | A | 4/1969 | Beard et al. | |
| 4,395,180 | A * | 7/1983 | Magnotte | 414/282 |
| 4,435,970 | A | 3/1984 | Sekiya | |
| 4,987,834 | A * | 1/1991 | Peck et al. | 104/300 |
| 7,698,923 | B2 | 4/2010 | Rackel | |
| 2005/0000263 | A1 | 1/2005 | Wittkopf | |

(Continued)

FOREIGN PATENT DOCUMENTS

| | | |
|---|---|---|
| DE | 1527628 A | 1/1970 |
| DE | 3123933 | 2/1982 |

(Continued)

*Primary Examiner* — Mark Le
(74) *Attorney, Agent, or Firm* — Lucas & Mercanti, LLP; Klaus P. Stoffel

(57) ABSTRACT

A device for handling and/or transporting work rolls and/or support rolls of a roll stand, by which the work rolls and/or support rolls can be brought from the roll stand into a roll workshop by a locomotive movable on a track. In order to be able to handle and transport different rolls using just one locomotive, without complicated coupling mechanisms, at least two tracks disposed at different heights are provided, on which a roll can be moved by the locomotive, and a lifting table is available, which is intended and suitable for raising or lowering the locomotive to one of the at least two different heights in order to bring it onto the respective track.

12 Claims, 7 Drawing Sheets

(56) References Cited

U.S. PATENT DOCUMENTS

| | | | | |
|---|---|---|---|---|
| 2009/0019909 | A1 | 1/2009 | Blecher | |
| 2009/0044588 | A1 | 2/2009 | Blecher | |
| 2009/0165522 | A1 * | 7/2009 | Rossigneux | 72/239 |

FOREIGN PATENT DOCUMENTS

| | | | | |
|---|---|---|---|---|
| EP | 1951452 | B1 | | 4/2009 |
| EP | 1951453 | B1 | | 4/2009 |
| EP | 1954416 | B1 | | 4/2009 |
| JP | S5170162 | A | | 6/1976 |
| JP | 56084108 | A | | 7/1981 |
| JP | S577307 | A | | 1/1982 |
| JP | 61-189803 | | * | 8/1986 |
| JP | 1306006 | A | | 12/1989 |
| JP | 6-135321 | | * | 5/1994 |
| RU | 2013147 | C1 | | 5/1994 |
| SU | 1227277 | A1 | | 4/1986 |
| SU | 1731315 | A1 | | 5/1992 |
| WO | 03015949 | | | 2/2003 |
| WO | 2005089972 | | | 9/2005 |
| WO | 2007080087 | | | 7/2007 |
| WO | 2007080091 | | | 7/2007 |

* cited by examiner

DEVICE FOR HANDLING AND/OR TRANSPORTING ROLLS OF A ROLL STAND

The present application is a 371 of International application PCT/EP2010/004904, filed Aug. 11, 2010, which claims priority of DE 10 2009 037 665.8, filed Aug. 14, 2009, the priority of these applications is hereby claimed and these applications are incorporated herein by reference.

BACKGROUND OF THE INVENTION

The invention pertains to a device for handling and/or transporting the work rolls and/or back-up rolls of a roll stand, with which the work rolls and/or the back-up rolls can be moved from the roll stand to a roll workshop by a locomotive traveling on a track.

Devices of this type make it possible to replace the rolls of a roll stand when the rolls have reached the end of their service life and must be taken back to a roll workshop for reprocessing. The removed rolls are replaced by a new set of rolls, so that production can continue.

Many different solutions for designing a device of the general type in question are known from the prior art. EP 1 954 416 B1 describes a device of this type, in which a support frame for holding the rolls comprises a changing carriage, wherein the support frame has rails on its top side, on which the changing carriage rests and can be moved transversely to a roll changing pit, wherein the changing carriage is designed with devices for holding the sets of rolls.

Similar solution are described in EP 1 951 452 E1, in WO 2005/089972 A1, in WO 2007/080091 A1 in EP 1 951 453 B1, in WO 03/015949 A1, and in DE 31 23 933 C2.

DE 15 27 628 A1 discloses a roll-changing device, which is characterized in that a roll support frame has two platforms arranged on above the other, each of which can hold a pair of work rolls, wherein this frame can be moved vertically, so that each of the two platforms can be arranged at an appropriate height for transferring the work rolls between the platform and the roll stand and between the platform and a roll storage location. It can also be used to keep a set of replacement rolls on hand near the roll stand until the rolls are installed. The disadvantage here is the relatively complicated design of the device.

The structural complexity of the standard roll-changing devices is acknowledged in WO 2007/080087 A1. To reduce this complexity, it is proposed here that a first set of rolls for a roll stand be changed by a first locomotive and that a second set of rolls in the same roll stand be changed by a second locomotive, wherein the same locomotive is used as the first locomotive and as the second locomotive. The locomotive travels on a track. It is disadvantageous that a relatively complex design is required so that the rolls in question can be coupled to one of the locomotives.

SUMMARY OF THE INVENTION

The present invention is based on the goal of improving the device of the general type in question in such a way that a simpler design is used and that the components which are required are of only limited complexity.

The invention achieves this goal by the characterizing features that at least two tracks, arranged at different heights, are provided, on which a roll can be moved by a locomotive, and in that a lifting table is present, which is designed specifically to raise and lower the locomotive to one of the at least two different heights and thus bring it onto the track in question.

One of the heights at which a track is positioned is preferably arranged so that at least one work roll can be moved out from the roll stand. Another height at which a track is positioned is preferably arranged so that least one back-up roll can be moved out from the roll stand.

The lifting table can be arranged at the end of the tracks. Alternatively, it could be arranged in the area of the tracks.

At least one of the tracks can either be directly adjacent to a side shift table or cross it. There are basically two different ways in which the side shift table can be positioned: The side shift table can be arranged between the lifting table and the roll stand. It is also possible, however, for the lifting table to be arranged between the roll stand and the side shift table.

Each of the tracks can be provided with rails, on which the locomotive can travel.

The rolls or sets of rolls to be transported slide directly on the transport rails.

A roll-changing frame can be used to hold the rolls. The length of the lifting table—seen in the travel direction of the locomotive—is preferably equal to or just slightly longer than the length of the locomotive. The overall length of the design can thus be considerably reduced.

The lifting table can be raised and lowered to the desired height by lifting and lowering means, so that the locomotive can easily travel from the lifting table onto the track and back again. The lifting table can be raised and lowered by at least one hydraulic piston-cylinder system.

With the proposed solution, only a single locomotive is needed to change all of the rolls of the roll stand; nevertheless, the rolls can be manipulated easily when handled and transported. Nor is any special coupling mechanism required so that the single locomotive can handle all of the various rolls.

The inventive proposal is used preferably for four-high stands, but it is not limited to them.

BRIEF DESCRIPTION OF THE DRAWING

Exemplary embodiments of the invention are illustrated in the drawing.

DETAILED DESCRIPTION OF THE INVENTION

Figure 1:
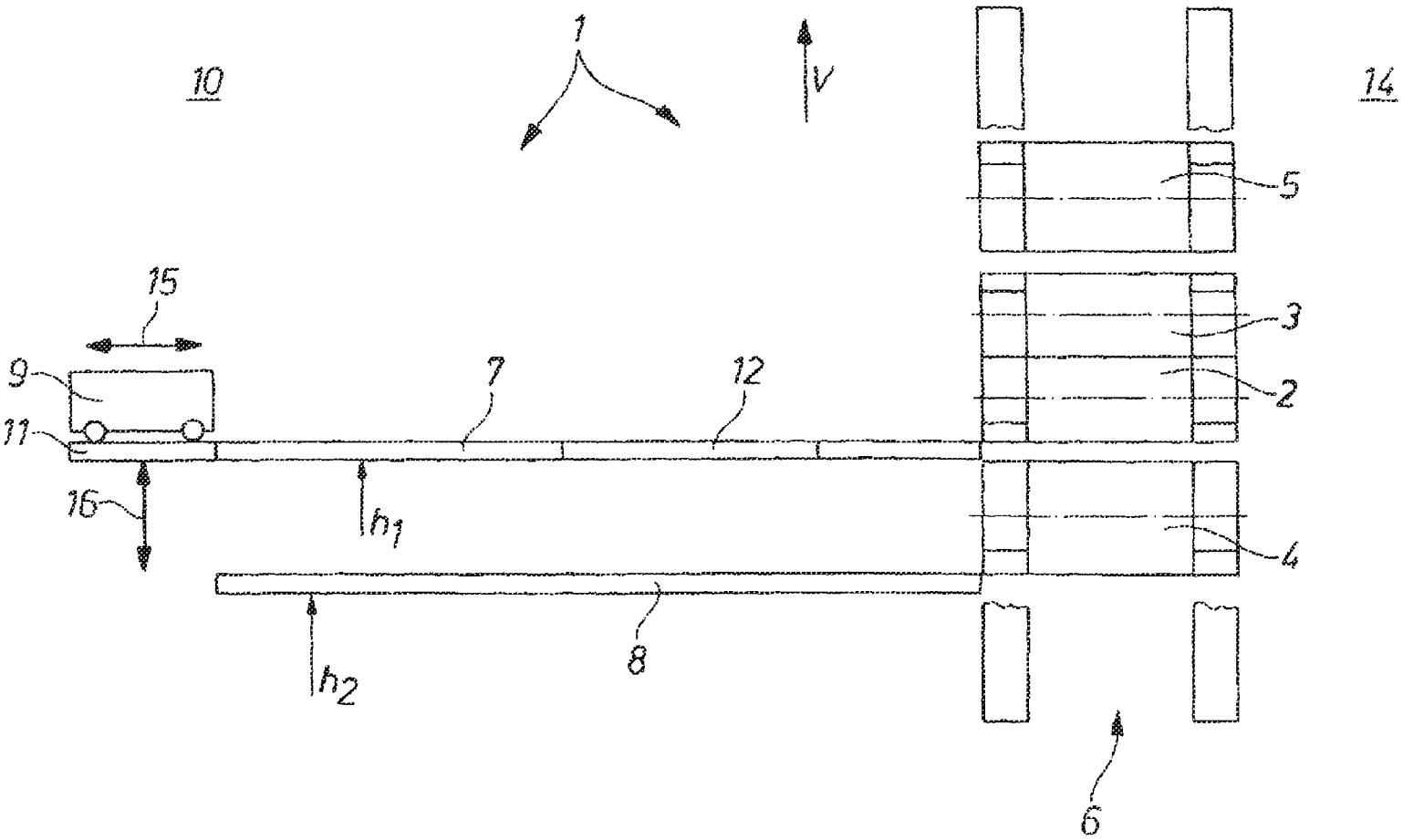
FIG. 1 shows a schematic side view of a device for handling and transporting the rolls of a roll stand.
Figure 2:
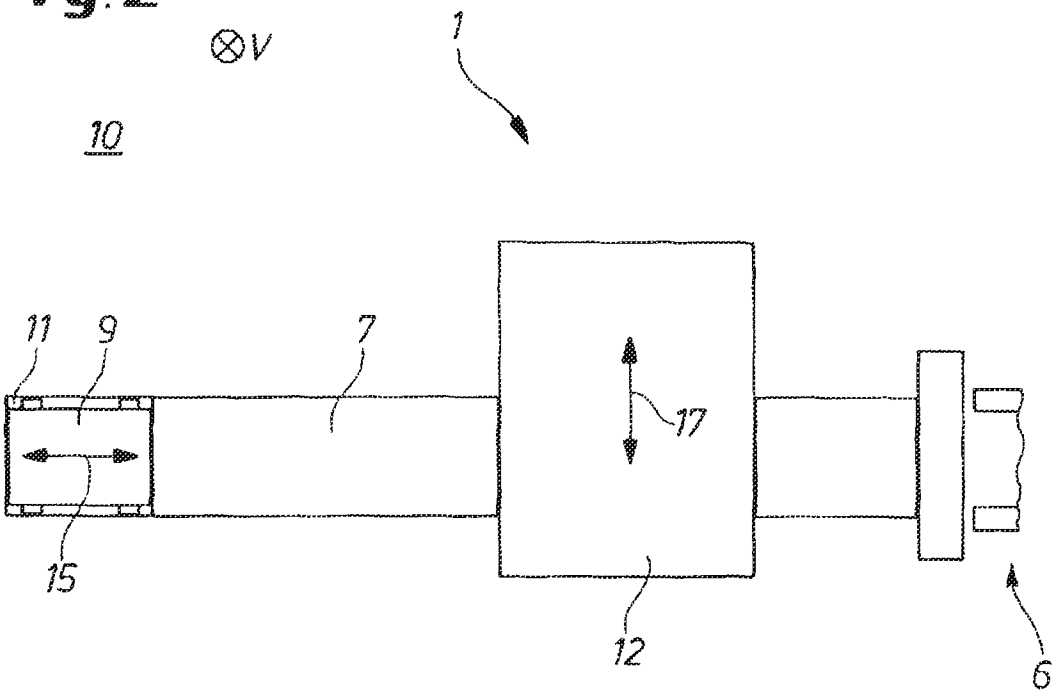
FIG. 2 shows a schematic top view of part of the device according to FIG. 1.

On the right side of FIGS. 1 and 2, a mill hall 14 is indicated, in which a roll stand 6 is installed. On the left side of the figures is a roll workshop 10. The two areas are separated from each other by a wall (not shown). A lower work roll 2 and an upper work roll 3 as well as a lower back-up roll 4 and an upper back-up roll 5 are arranged in the roll stand 6. When a roll 2, 3, 4, 5 has reached the end of its service life, it is removed from the roll stand 6 and sent back to the roll workshop 10 for reprocessing, e.g., for regrinding. The device 1 is used for this purpose.

A locomotive 9 is used to transport the rolls 2, 3, 4, 5 from the mill hall 14 to the roll workshop 10 and back again. The locomotive, as it moves along the track 7, 8, can push or pull the roll or sets of rolls directly on the transport rails. The direction in which the locomotive 9 travels is indicated in FIGS. 1 and 2 by the double arrow 15. More precisely, two tracks 7 and 8 are present here, which are arranged at different heights $h_1$ and $h_2$ in the direction of the vertical V.

The first height $h_1$, i.e., that at which the track 7 is positioned, is selected so that it is at the correct level for pulling a work roll 2 or both work rolls 2, 3 out of the roll stand 6 and or pushing these rolls back into the roll stand 6. The second height $h_2$, i.e., the height at which the track 8 is positioned, is lower down and is aligned so that a back-up roll 4 can be pulled out of the roll stand 6 and pushed back into the roll stand 6.

Figure 3:
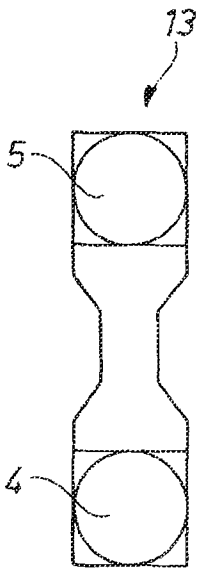
FIG. 3 shows a schematic diagram of a roll-changing frame for back-up rolls, seen in the axial direction of the rolls.

With respect to the changing of the back-up rolls 4, 5, reference can be made to the roll-changing frame 13 sketched in FIG. 3, which is used to handle the back-up rolls 4, 5. The details of a roll-changing frame of this type can be found in EP 1 951 452 B1 of the applicant, to which reference is herewith made in this respect.

The essential point is that only a single locomotive 9 is used to execute all of the movements required to change all of the rolls 2, 3, 4, 5. For this purpose it is provided according to the invention that a lifting table 11 is present. This table is designed so that it can raise or lower the locomotive 9 to one of the two heights $h_1$ or $h_2$ to bring the locomotive onto the desired track 7 or 8. The lifting movement of the lifting table 11 is indicated in FIG. 1 by the double arrow 16. Interlocks 18 are provided in the lower part of the shaft to ensure that the lifting table operates safely.

As can be seen especially clearly in FIG. 2, a side shift table 12 is also provided. With this table, a sideways displacement can be achieved, namely, in the direction of the double arrow 17 in FIG. 2. Detailed information on the technology of this side shift can be found in the applicant's EP 1 951 453 B1, to which, in this regard, reference is herewith made.

With the proposed solution, the goal is achieved that a single locomotive 9 can be used to handle and transport all of the rolls 2, 3, 4, 5 of the roll stand 6. Nevertheless, the locomotive 9 can always be used in optimal fashion and requires no special coupling devices, which simplifies its working design.

FIGS. 4-8 show a total of three different concrete exemplary embodiments of the invention. All three exemplary embodiments work in principle according to the inventive concept; that is, (at least) two tracks 7, 8 are arranged at different heights $h_1$, $h_2$, on which a roll 2, 3, 4, 5 can be moved by the locomotive 9, wherein a lifting table 11 is also present, which is designed specifically for the task of raising or lowering the locomotive 9 to one of the at least two different heights $h_1$, $h_2$ and thus to bring it onto one of the two tracks 7, 8.

Figure 4:
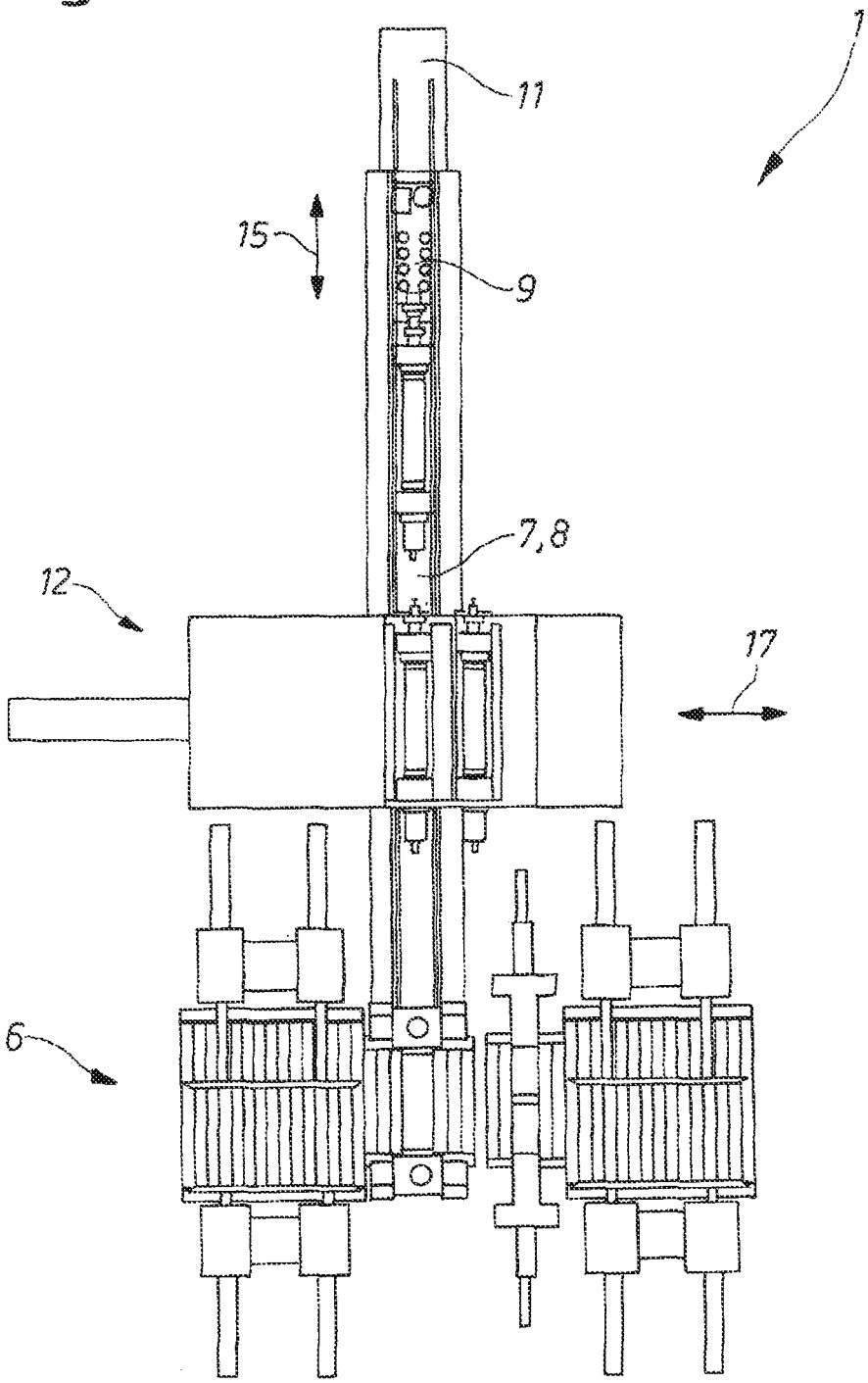
FIG. 4 shows a first concrete exemplary embodiment of the invention, wherein the top view shows the device for handling and transporting the rolls of a roll stand.
Figure 5A:
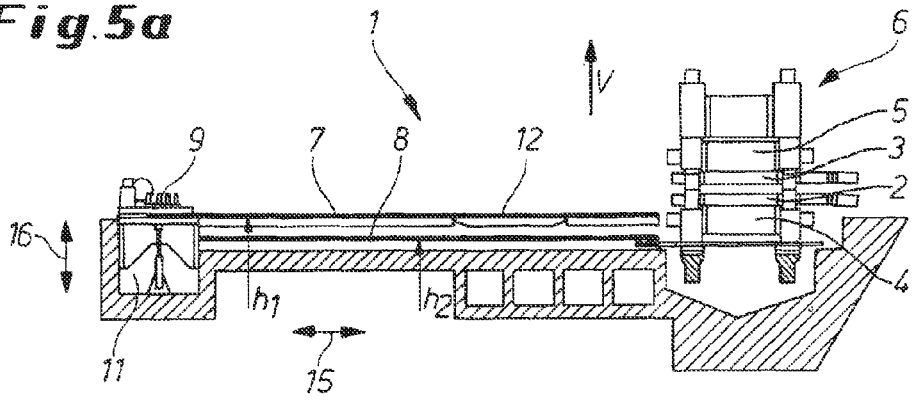
FIG. 5*a* shows a side view of the device according to FIG. 4, wherein none of the rolls is yet being transported.
Figure 5B:
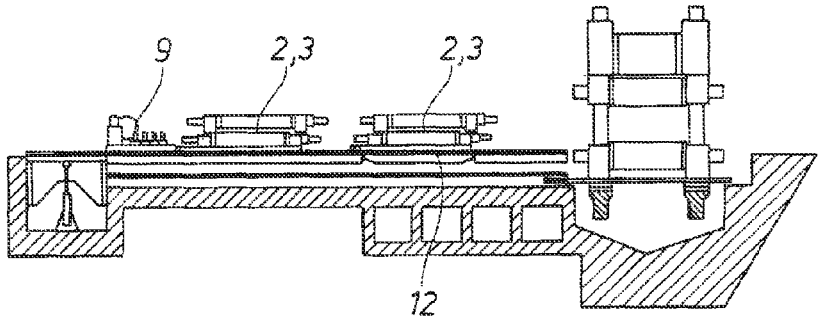
FIG. 5*b* shows a side view of the device according to FIG. 4, wherein the work rolls are now being transported.
Figure 5C:
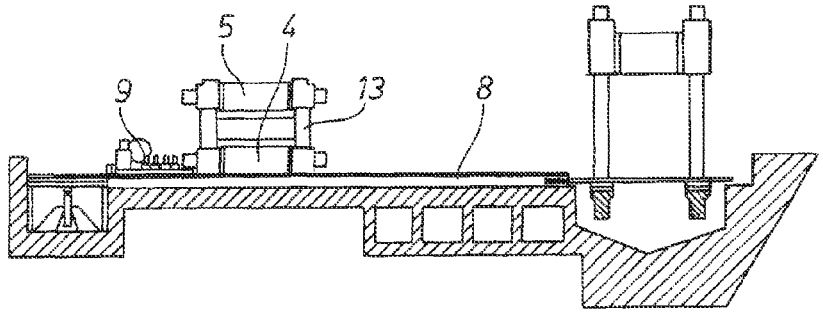
FIG. 5*c* shows a side view of the device according to FIG. 4, wherein the back-up rolls are being transported.

In the first concrete exemplary embodiment according to FIGS. 4 and 5, the side shift table 12 is arranged in the area of the tracks 7, 8; that is, the side shift table crosses the tracks 7, 8. The lifting table 11 is located at the end of the tracks 7. 8. The locomotive 9 is designed to be relatively powerful. As can be seen in FIG. 5*b*, a pair of work rolls 2, 3 is being moved directly on the transport rails. As can be seen in FIG. 5*c*, the locomotive 9 is able to move the two back-up rolls 4, 5 on a roll-changing frame 13 (upper track 7 not shown in FIG. 5*c*).

Figure 6A:
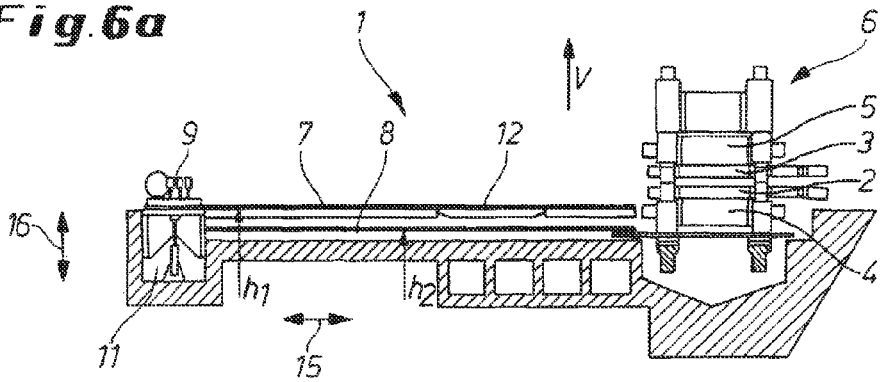
FIG. 6*a* shows a side view of the device according to a second concrete exemplary embodiment with a less powerful locomotive, wherein none of the rolls is yet being transported.
Figure 6B:
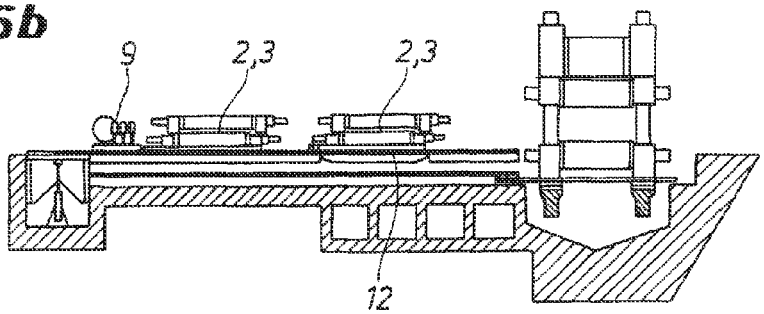
FIG. 6*b* shows a side view of the device belonging to FIG. 6*a*, wherein the work rolls are now being transported.
Figure 6C:
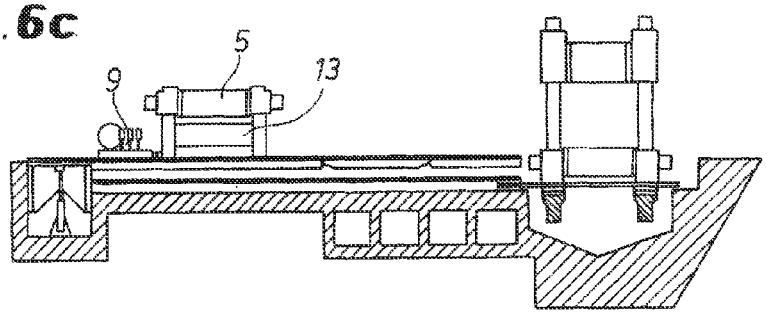
FIG. 6*c* shows a side of the device belonging to FIG. 6*a*, wherein the upper back-up roll is being transported.
Figure 6D:
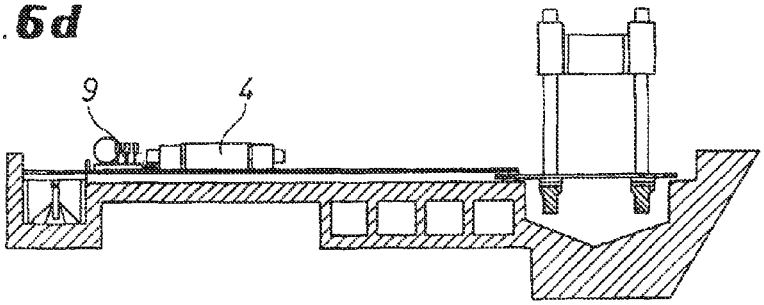
FIG. 6*d* shows a side view of the device belonging to FIG. 6*a*, wherein the lower back-up roll is being transported.

The second concrete exemplary embodiment according to FIGS. 6*a*-6*d* has a design similar to that of the first exemplary embodiment (FIGS. 4 and 5). Namely, the side shift table 12 is arranged in the area of the tracks 7, 8; the top view of the second exemplary embodiment corresponds to that of the first exemplary embodiment (see FIG. 4). The only difference is that here the locomotive 9 is less powerful. Accordingly, although it is still possible to move the two work rolls 2, 3 as a pair (see FIG. 6*b*), the back-up rolls 4, 5 must be moved individually by the locomotive 9, as shown in FIGS. 6*c* and 6*d*.

Figure 7:
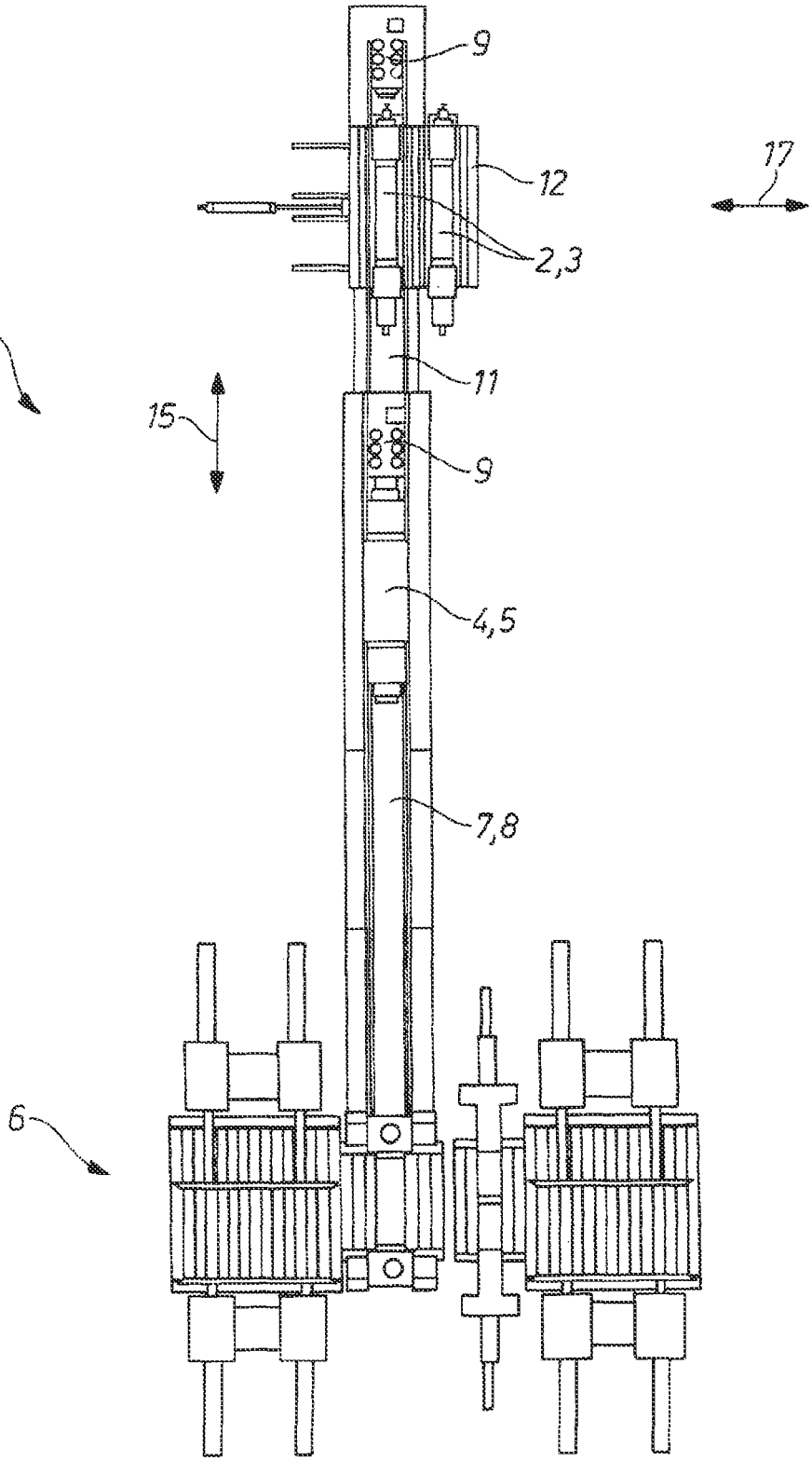
FIG. 7 shows a top view of the device according to a third concrete exemplary embodiment with a less powerful locomotive.
Figure 8A:
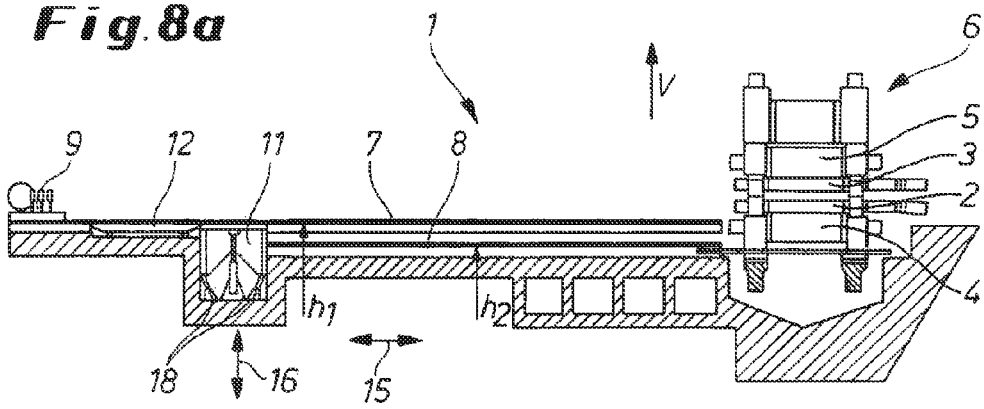
FIG. 8*a* shows a side view of the device according to FIG. 7, wherein none of the rolls is yet being transported.
Figure 8B:
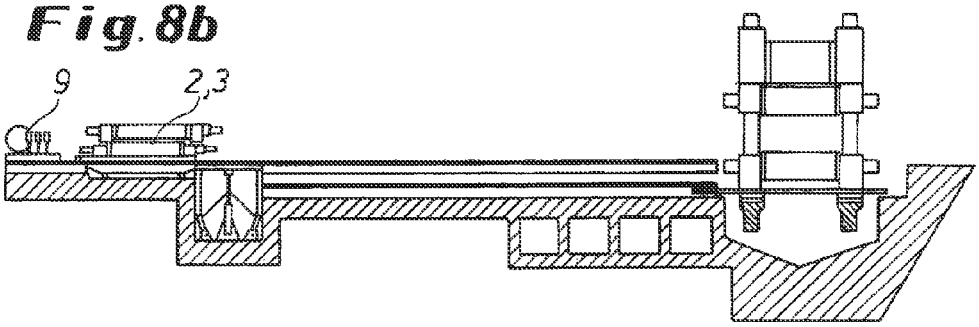
FIG. 8*b* shows a side view of the device according to FIG. 7, wherein the work rolls are now being transported.
Figure 8C:
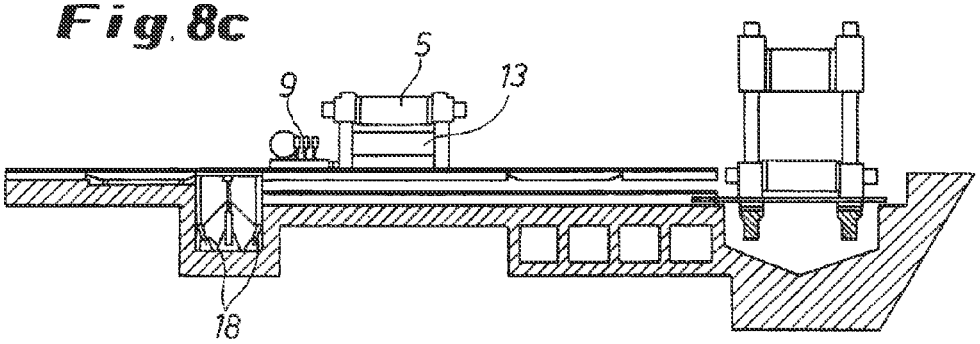
FIG. 8*c* shows a side view of the device according to FIG. 7, wherein the upper back-up roll is being transported.
Figure 8D:
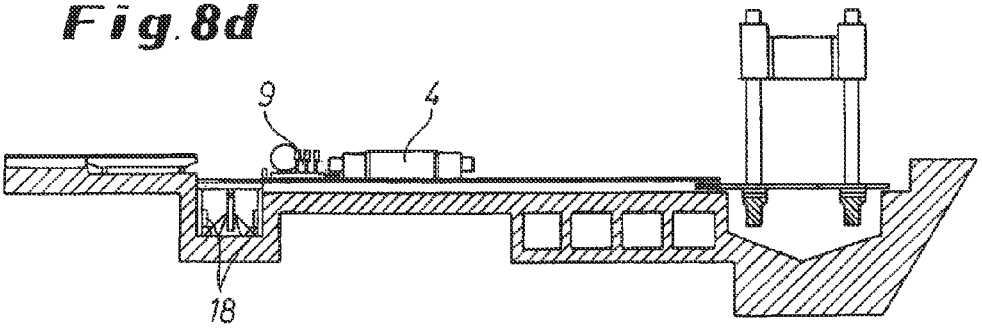
FIG. 8*d* shows a side view of the device according to FIG. 7, wherein the lower back-up roll is being transported.

The third concrete exemplary embodiment according to FIGS. 7 and 8 is based on the second exemplary embodiment; that is, a relatively low-power locomotive 9 is used. Accordingly, the back-up rolls 4, 5 must be moved individually (see FIGS. 8*c* and 8*d*). The difference from the previous exemplary embodiments is that the lifting table 11 is no longer arranged at the end of the tracks but rather in the area of the tracks 7, 8. That is, the tracks 7, 8 continue on the far side of the lifting table into the area removed from the roll stand 6.

Whereas the side shift table 12 could in principle be arranged between the lifting table 11 and the roll stand 6 in this case as well, it is provided in the exemplary embodiment according to FIGS. 7 and 8 that the side shift table 12 is provided on the far side of the lifting table 11 in the area of the tracks 7, 8 farther away from the roll stand 6. The side shift table 12, furthermore, is smaller than in the cases shown in FIGS. 4-6.

Typical travel speeds of the roll-changing carriage pulled by the locomotive 9 when loaded with work rolls is approximately in the range of 200-400 mm/s and is on the same order of magnitude when loaded with a single back-up roll. When the carriage is loaded with two back-up rolls, a speed in the range of 50-100 mm/s is typical.

The invention claimed is:

1. A device for handling and/or transporting work rolls and/or back-up rolls of a roll stand, with which the work rolls and/or the back-up rolls can be brought from the roll stand into a roll workshop by a locomotive, the device comprising:

no more than one locomotive;

at least two tracks arranged at different heights and on which a roll is pushed or pulled by the locomotive; and no more than one lifting table operatively arranged to raise and lower the locomotive to one of the at least two different heights to bring it onto a desired one of the tracks, wherein one of the tracks is arranged at a first height so that at least one work roll can be moved out of the roll stand and another one of the tracks is arranged at a second height so that at least one back-up roll can be moved out of the roll stand.

2. The device according to claim 1, wherein the lifting table is arranged at an end of the tracks.

3. The device according to claim 1, wherein the lifting table is arranged in an area of the tracks.

4. The device according to claim 1, further comprising a side shift table, at least one of the tracks being directly adjacent to or crossing the side shift table.

5. The device according to claim 4, wherein the side shift table is arranged between the lifting table and the roll stand.

6. The device according to claim 4, wherein the lifting table is arranged between the roll stand and the side shift table.

7. The device according to claim 1, wherein each of the tracks is provided with rails, on which the locomotive can travel.

8. The device according to claim 1, further comprising a roll-changing frame operatively arranged for changing the back-up rolls.

9. The device according to claim 1, wherein the lifting table has a length, seen in a travel direction of the locomotive, equal to or slightly greater than a length of the locomotive.

10. The device according to claim 1, further comprising means for raising and lowering the lifting table, the raising and lowering means including an automatic positioning control system for the height.

11. The device according to claim 1, further comprising a hydraulic piston-cylinder system arranged to raise and lower the lifting table.

12. A device for handling and/or transporting work rolls and/or back-up rolls of a roll stand, with which the work rolls and/or the back-up rolls can be brought from the roll stand into a roll workshop by a locomotive, the device consisting of:

a single locomotive;

at least two tracks arranged at different heights and on which a roll is pushed or pulled by the locomotive; and a lifting table operatively arranged to raise and lower the locomotive to one of the at least two different heights to bring it onto a desired one of the tracks.

* * * * *